US007467575B2

(12) United States Patent
Lai

(10) Patent No.: US 7,467,575 B2
(45) Date of Patent: Dec. 23, 2008

(54) REPLACEMENT ASSEMBLY OF HANDLE TOOL

(76) Inventor: Jin-Tsai Lai, 235 Chung-Ho Box 8-24, Taipei (TW)

( * ) Notice: Subject to any disclaimer, the term of this patent is extended or adjusted under 35 U.S.C. 154(b) by 1 day.

(21) Appl. No.: 11/645,342

(22) Filed: Dec. 26, 2006

(65) Prior Publication Data

US 2008/0148909 A1 Jun. 26, 2008

(51) Int. Cl.
*B25B 23/16* (2006.01)
*B25G 1/04* (2006.01)

(52) U.S. Cl. ..... 81/177.1; 81/177.85

(58) Field of Classification Search ..... 81/177.1, 81/177.2, 177.85
See application file for complete search history.

(56) References Cited

U.S. PATENT DOCUMENTS 5,836,223 A * 11/1998 Lin ..... 81/436
6,901,826 B2 * 6/2005 Huang ..... 81/177.2
7,089,828 B1 * 8/2006 Ho ..... 81/60
7,146,885 B2 * 12/2006 Hwang et al. ..... 81/177.2
7,287,449 B2 * 10/2007 Abel et al. ..... 81/177.2

* cited by examiner

*Primary Examiner*—David B Thomas

(57) ABSTRACT

A replacement assembly of a handle tool comprises a handle having an axial receiving hole; an adjusting ring; the adjusting ring being formed with a stop block; an driving head having an annular recess; a retaining cylinder installed at one end of the receiving hole for confining the adjusting ring; the retaining cylinder having a positioning hole for receiving the driving head; the retaining cylinder having at least one through hole which is communicated to the positioning hole. The stop block enters into the annular recess of the shaft from the through hole of the retaining cylinder. The retaining cylinder has a large head portion and a small waist; and the adjusting ring is engaged to the waist and is confined by the head portion to be combined with the handle.

5 Claims, 5 Drawing Sheets

REPLACEMENT ASSEMBLY OF HANDLE TOOL

FIELD OF THE INVENTION

The present invention relates to hand tools, and particularly to a replacement assembly of a handle tool which has a simple structure and can be operated easily and conveniently.

BACKGROUND OF THE INVENTION

In a prior art improved detachable screw structure, an interior of a handle is formed with a recess. The recess is installed with a fixing seat. An interior of the fixing seat has a through hole for receiving an opener rod into the through hole of the fixing seat. A lateral surface of the fixing seat has a recess. A press unit passes through the recess to extend to the through hole and presses the periphery surface of the opener rod so as to position the opener rod. The longitudinal direction of the fixing seat is corresponding to the axial direction of the through hole. Two ends of the longitudinal direction have respective buckling portions. The press unit is a long plate made of compressible and elastic non-metal material. Tow ends corresponding to the longitudinal direction have respective positioning portions which can be positioned on the buckling portion of the fixing seat. A pressing portion protrudes from one lateral surface of the recess. The pressing portion inserts into the through hole.

The prior art structure has the effect of increasing the usages of the screw structure. However, the structure of the opener head is too complicated and then many processes are required in manufacturing and assembling. Thereby the complicated structure causes the rates of fault to be increased. Especially, the hand tools, such as openers, are frequently used in the complicated working fields. Thereby the user is inconvenient. As a whole, the prior art is not practical and is necessary to be improved.

SUMMARY OF THE INVENTION

Accordingly, the primary object of the present invention is to provide a hand tool, and particularly to a replacement assembly of a handle tool which has a simple structure and can be operated easily and conveniently.

To achieve above objects, the present invention provides a replacement assembly of a handle tool comprising: a handle having an axial receiving hole; an adjusting ring; the adjusting ring being formed with a stop block; a driving head having an annular recess; a retaining cylinder installed at one end of the receiving hole for confining the adjusting ring; the retaining cylinder having a positioning hole for receiving the driving head; the retaining cylinder having at least one through hole which is communicated to the positioning hole; wherein the stop block enters into the annular recess of the driving head from the through hole of the retaining cylinder. The retaining cylinder has a large head portion and a small waist; the adjusting ring is engaged to the waist and is confined by the head portion to be combined with the handle. The retaining cylinder has a protrusion at an axial direction thereof; and the handle has a slot for positioning the protrusion. The handle has a buckling block; and the adjusting ring has a rib; the buckling block and the rib serves for confining the adjusting ring to rotate in a predetermined range. A bottom of the positioning hole has a regular polygonal shape; and a distal end of the shaft is also a regular polygonal shape corresponding to that of the positioning hole.

The various objects and advantages of the present invention will be more readily understood from the following detailed description when read in conjunction with the appended drawing.

DETAILED DESCRIPTION OF THE INVENTION

Figure 1:
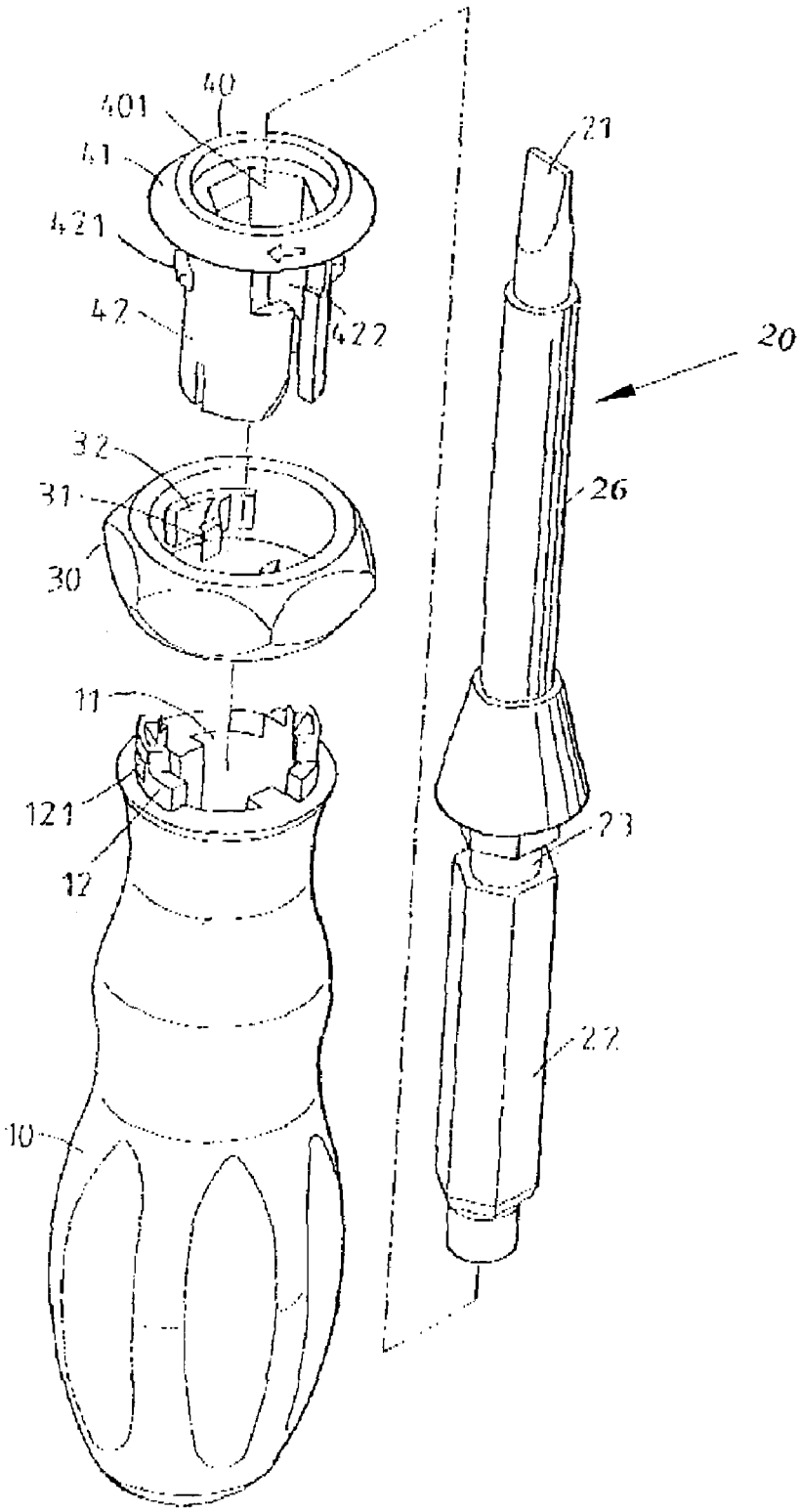
FIG. 1 is an exploded perspective view of the replacement assembly of a handle tool of the present invention.
Figure 2:
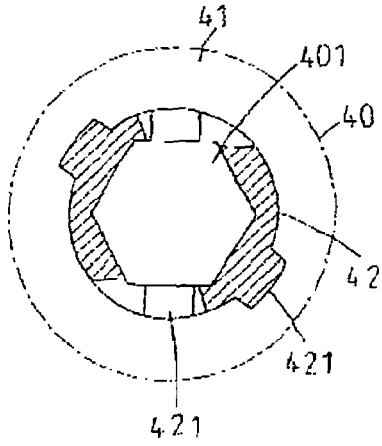
FIG. 2 is an elevational schematic view about the retaining cylinder, adjusting ring and handle of the present invention.
Figure 2:
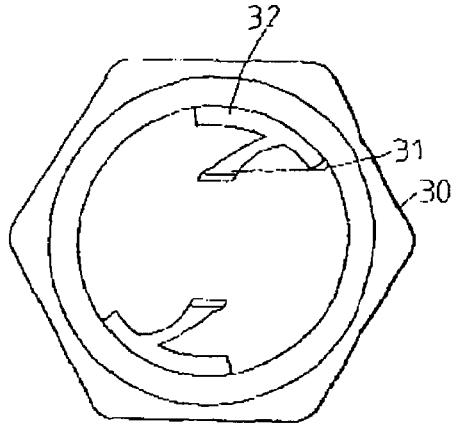
Figure 2:
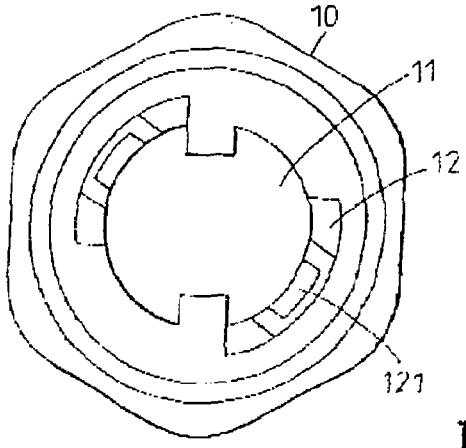
Figure 3:
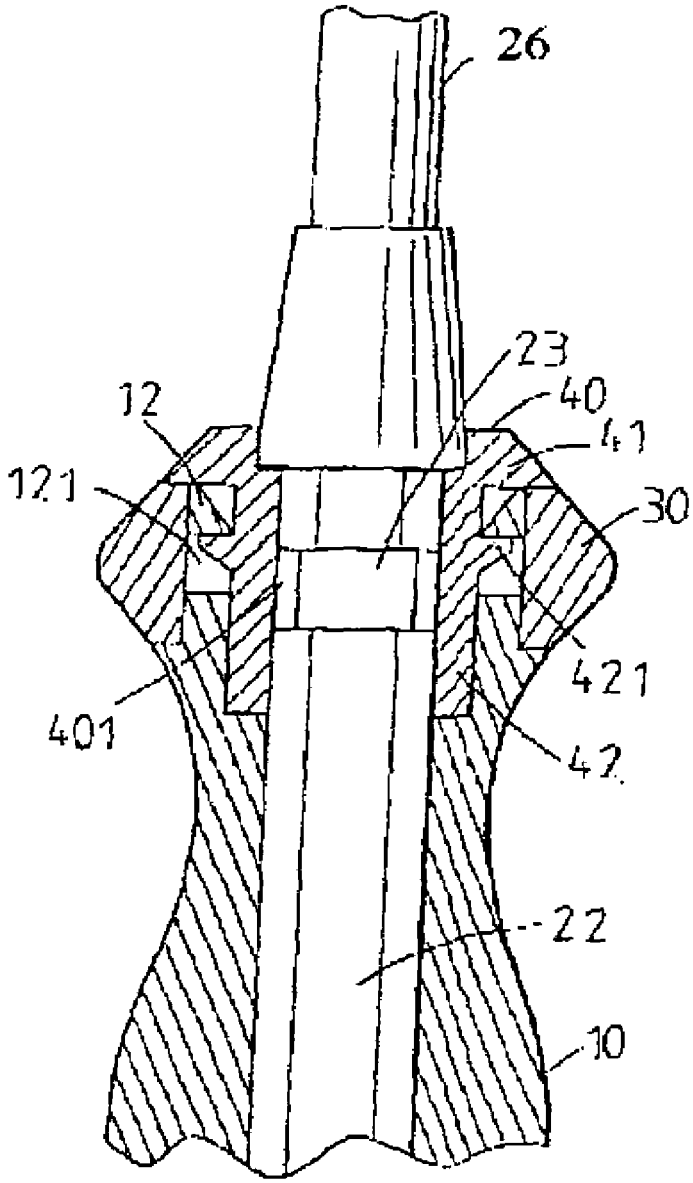
FIG. 3 is a cross sectional view about the replacement assembly of a handle tool of the present invention.
Figure 4:
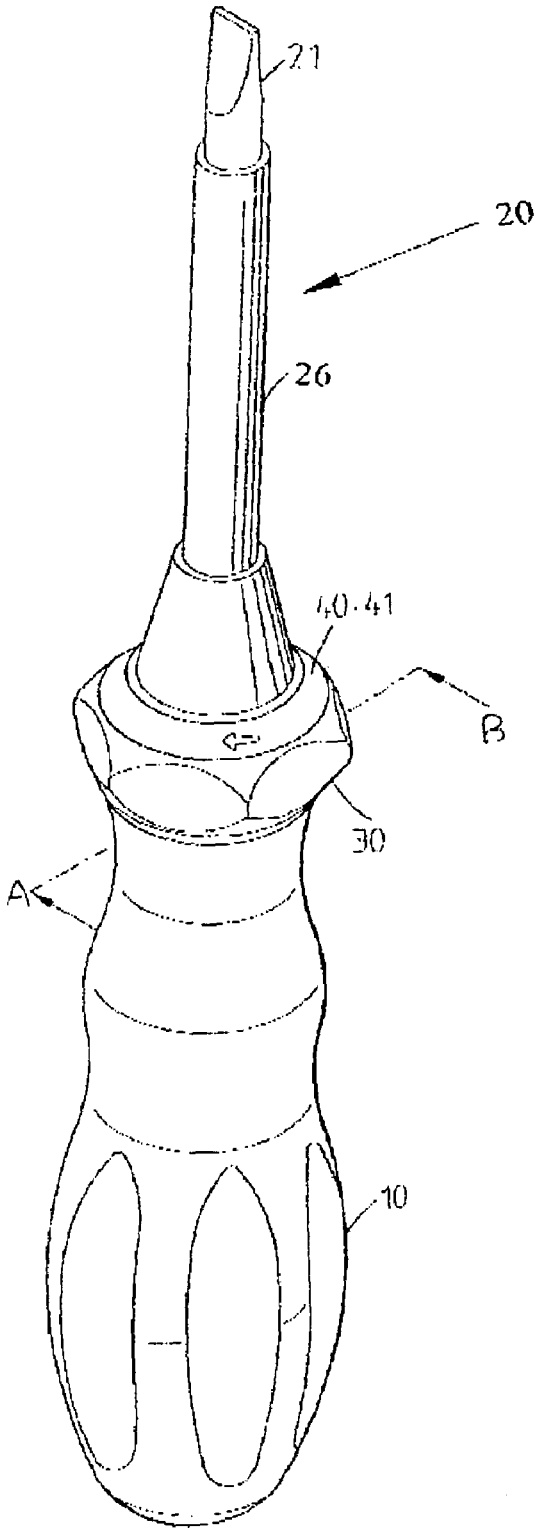
FIG. 4 is a perspective view of the replacement assembly of a handle tool of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the replacement assembly of a handle tool of the present invention is illustrated. The present invention has the following elements.

A driving head 20 includes a shaft 24, a driving end 21 and an insertion end 22. An annular recess 23 is formed between the driving end 21 and the insertion end 22. In this embodiment, the driving end 21 has a thin and sharp front edge. Also, it may be a cruciform, a star shape, hexagonal shape, etc. The insertion end 22 may be a regular polygonal shape.

The handle 10 has a rod shape. The insertion end 22 may be inserted into the handle 10 and is driven by the handle 10. The handle 10 has an axial receiving hole 11 for receiving and positioning the driving head 20. A bottom of the driving head 20 has a shape corresponding to that of the insertion end 22 of the driving head 20 (not shown) for preventing the driving head 20 to rotate so as to provide a twisting force to screw a screwing object. An opening end of the receiving hole 11 of the handle 10 has two buckling blocks 12 at two sides. Each buckling block 12 is formed with a slot 121 for retaining a retaining cylinder 40.

The retaining cylinder 40 is formed with an axial positioning hole 401 for receiving a portion of the driving head 20 having the annular recess 23. A top end of the retaining cylinder 40 has a larger outer diameter so as to form as a head portion 41. A bottom of the head portion 41 of the retaining cylinder 40 extends with a waist 42 which is slenderer than the head portion 41. A radial protrusion 421 can be embedded into the stop slot 121.

An adjusting ring 30 is made of flexible material. The adjusting ring 30 is engaged to the waist 42 of the retaining cylinder 40. An inner side of the adjusting ring 30 is installed with two stop blocks 31 and each stop block 31 has a rib 32. The stop block 31 enters into the positioning hole 401 from a through hole 422 in the waist 42 of the retaining cylinder 40.

In assembly of the present invention, the adjusting ring 30 is engaged to the retaining cylinder 40 and the stop block 31 of the adjusting ring 30 enters into the through hole 422 of the retaining cylinder 40. The waist 42 of the retaining cylinder 40 passes through the receiving hole 11 of the handle 10. The protrusion 421 of the waist 42 is engaged to the slot 121 of the buckling block 12 of the handle 10. The adjusting ring 30 is confined by the head portion 41 of the retaining cylinder 40. The stop block 31 of the adjusting ring 30 is at the same radial plane of the buckling block 12 of the handle 10. The buckling block 12 and the rib 32 confine the rotation angle of the adjusting ring 30.

Figure 5:
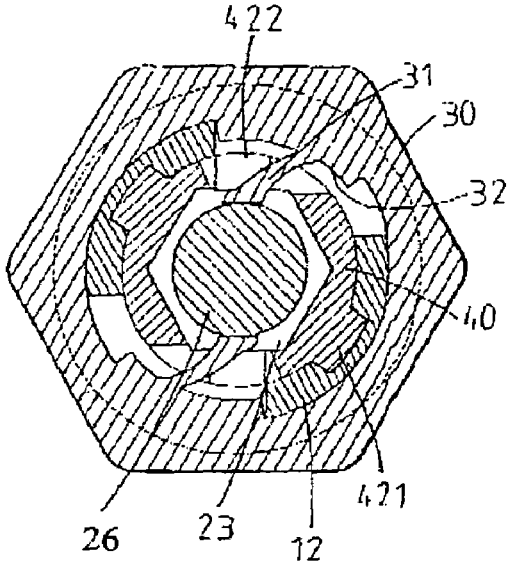
FIG. 5 is a schematic cross sectional view showing the buckling state of the present invention along line AB of FIG. 4.
Figure 6:
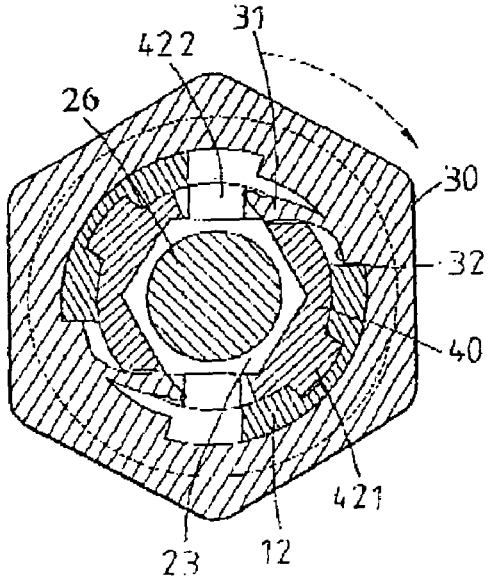
FIG. 6 is a schematic cross sectional view showing the release state of the present invention along line AB of FIG. 4

In use of the present invention, referring to FIGS. 5 and 6, generally, the stop block 31 of the adjusting ring 30 enters into the positioning hole 401 from the through hole 422 of the retaining cylinder 40 and is buckled to the annular recess 23 of the driving head 20 so that the driving head 20 is combined to the handle 10.

When the user desires to update the driving head 20, referring to FIG. 6, the adjusting ring 30 is moved. The adjusting ring 30 is confined by the stop block 31 and the buckling block 12 of the handle 10 so as to rotate in a finite angle range. When the adjusting ring 30 rotates, the stop block 31 retracts out of the positioning hole 401 to bend therein. Then the stop block 31 separates from the annular recess 23 of the driving head 20. Therefore, the driving head 20 can be taken down. Other driving head 20 with the driving end 21 is placed upon the handle 10. After the driving head 20 is updated, the user only needs to release the adjusting ring 30. By the elastic force from the bending of the stop block 31 of the adjusting ring 30, the adjusting ring 30 restores. Then the stop block 31 enters into the annular recess 23 of the driving head 20 again so that the driving head 20 is positioned again.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A replacement assembly of a handle tool comprising:

a handle having an axial receiving hole;

an adjusting ring; the adjusting ring being formed with a stop block;

a driving head; the driving head having an annular recess;

a retaining cylinder installed at one end of the receiving hole for confining the adjusting ring; the retaining cylinder having a positioning hole for receiving the driving head; the retaining cylinder having at least one through hole which is communicated to the positioning hole;

wherein the stop block enters into the annular recess of the driving head from the through hole of the retaining cylinder.

2. The replacement assembly of a handle tool as claimed in claim 1, wherein the retaining cylinder has a large head portion and a small waist; and the through hole being formed in the waist; the adjusting ring is engaged to the waist and is confined by the head portion to be combined with the handle.

3. The replacement assembly of a handle tool as claimed in claim 1, wherein the retaining cylinder has a protrusion at an axial direction thereof; and the handle has a slot for positioning the protrusion.

4. The replacement assembly of a handle tool as claimed in claim 1, wherein the handle has a buckling block; and the adjusting ring has a rib; the buckling block and the rib serves for confining the adjusting ring to rotate in a predetermined range.

5. The replacement assembly of a handle tool as claimed in claim 1, wherein a bottom of the positioning hole has a regular polygonal shape; and a distal end of the driving head has also a regular polygonal shape corresponding to that of the positioning hole.

* * * * *